US008712279B2

(12) United States Patent
Ueno

(10) Patent No.: US 8,712,279 B2
(45) Date of Patent: Apr. 29, 2014

(54) WARM AIR GENERATING APPARATUS, SHEET FEEDING APPARATUS, AND IMAGE FORMING APPARATUS INCLUDING WARM AIR GENERATING APPARATUS AND SHEET FEEDING APPARATUS

(75) Inventor: Yasunori Ueno, Osaka (JP)

(73) Assignee: Kyocera Mita Corporation (JP)

( * ) Notice: Subject to any disclaimer, the term of this patent is extended or adjusted under 35 U.S.C. 154(b) by 828 days.

(21) Appl. No.: 12/547,594

(22) Filed: Aug. 26, 2009

(65) Prior Publication Data

US 2010/0054834 A1 Mar. 4, 2010

(30) Foreign Application Priority Data

Aug. 26, 2008 (JP) ..... 2008-216927

(51) Int. Cl.
*G03G 15/00* (2006.01)
*G03G 21/00* (2006.01)
*B65H 3/60* (2006.01)

(52) U.S. Cl.
USPC ..... 399/94; 271/97

(58) Field of Classification Search
USPC ..... 399/390, 92, 94, 97, 393; 271/97
See application file for complete search history.

(56) References Cited

U.S. PATENT DOCUMENTS

| | | | | | |
|---|---|---|---|---|---|
| 4,400,270 | A * | 8/1983 | Hillman | 210/103 |
| 4,741,169 | A * | 5/1988 | Linstromberg | 62/135 |
| 4,924,350 | A * | 5/1990 | Reddy et al. | 361/704 |
| 5,816,235 | A * | 10/1998 | Kim et al. | 126/39 H |
| 6,477,047 | B1 * | 11/2002 | Markwardt et al. | 361/704 |
| 7,249,759 | B2 * | 7/2007 | Komatsu et al. | 271/97 |
| 2005/0217138 | A1 * | 10/2005 | Kohne et al. | 34/603 |
| 2008/0198900 | A1 * | 8/2008 | Myhre | 374/179 |

FOREIGN PATENT DOCUMENTS

| | | | | |
|---|---|---|---|---|
| EP | 1312289 | A1 * | 5/2003 | A47J 27/21 |
| JP | 61250420 | A * | 11/1986 | F23N 5/14 |
| JP | 11032921 | A * | 2/1999 | F24C 3/12 |
| JP | 2000162052 | A * | 6/2000 | G03G 15/20 |
| JP | 2001-48366 | | 2/2001 | |
| JP | 2004003722 | A * | 1/2004 | F24F 1/00 |
| JP | 2005296546 | A * | 10/2005 | A47L 15/42 |
| JP | 2006300363 | A * | 11/2006 | F26B 9/02 |
| JP | 2008121480 | A * | 5/2008 | F04B 39/00 |

* cited by examiner

*Primary Examiner* — Nguyen Ha
(74) *Attorney, Agent, or Firm* — Gerald E. Hespos; Michael J. Porco; Matthew T. Hespos

(57) ABSTRACT

A warm air generating apparatus includes: a blowing apparatus for generating an air flow in a predetermined direction; a heating member disposed on a flow path of the air flow for heating air; a temperature detection member that has a heat sensing portion and detects a temperature of the heating member; and a biasing member for applying a biasing force that causes the heat sensing portion to contact a part of the heating member.

13 Claims, 10 Drawing Sheets

WARM AIR GENERATING APPARATUS, SHEET FEEDING APPARATUS, AND IMAGE FORMING APPARATUS INCLUDING WARM AIR GENERATING APPARATUS AND SHEET FEEDING APPARATUS

BACKGROUND OF THE INVENTION

1. Field of the Invention

The present invention relates to a warm air generating apparatus for blowing warm air onto an object, a sheet feeding apparatus including the warm air generating apparatus, and an image forming apparatus including the warm air generating apparatus and the sheet feeding apparatus.

2. Description of the Background Art

In an image forming apparatus such as a printer, a copier, or a facsimile, gloss enamel paper having enhanced whiteness, film sheets, tracing paper, and so on are used as a sheet on which an image is recorded in addition to high quality paper and regular paper. These special types of paper exhibit a strong inter-sheet sticking force, and it is therefore difficult to prevent multi-feeding of the sheets. Hence, special measures must be taken in relation to sheet dispatch.

An upper face and a peripheral part of a stack of sheets housed in a sheet feeding cassette (sheet feeding apparatus) are exposed to outside air, and are therefore likely to contain a large amount of moisture. In other words, the upper face and side faces of the sheet stack swell due to moisture absorption, whereas the inside of the sheet stack contains a smaller amount of moisture than the upper face and side faces and therefore swells less. As a result, pressure in an inside space (an inter-sheet space) of the sheet stack may turn negative such that the sheets stick together.

A conventional sheet feeding apparatus includes a mechanism for blowing warm air onto the side face of the sheet stack to loosen the sheet stack by separating sheets that are stuck together prior to sheet feeding. For example, Japanese Unexamined Patent Application No. 2001-48366 discloses a technique for improving sheet drying efficiency by blowing warm air onto the side face of a sheet stack and appropriately adjusting the humidity of the warm air.

When a mechanism such as that described above for blowing warm air onto the sheet stack is employed, a warm air generating apparatus that typically includes an electric heater and an air blowing fan and is capable of generating a high-temperature air flow is used. In this type of warm air generating apparatus, the temperature of the electric heater is preferably detected accurately to achieve optimum temperature control of the air flow and prevent overheating of the electric heater. However, in a conventional warm air generating apparatus applied to a sheet feeding apparatus, sufficient measures have not been taken with respect to this point.

SUMMARY OF THE INVENTION

An object of the present invention is to provide a warm air generating apparatus capable of performing accurate temperature control through a simple constitution, a sheet feeding apparatus including the warm air generating apparatus, and an image forming apparatus including the warm air generating apparatus and the sheet feeding apparatus.

A warm air generating apparatus according to an aspect of the present invention for achieving this object includes: a blowing apparatus for generating an air flow in a predetermined direction; a heating member disposed on a flow path of the air flow for heating air; a temperature detection member that has a heat sensing portion and detects a temperature of the heating member; and a biasing member for applying a biasing force that causes the heat sensing portion to contact a part of the heating member.

A sheet feeding apparatus according to another aspect of the present invention includes: a sheet accommodating portion for accommodating a sheet stack constituted by a plurality of sheets; and a warm air generating apparatus capable of blowing warm air onto the sheet stack accommodated in the sheet accommodating portion, wherein the warm air generating apparatus has the constitution described above.

An image forming apparatus according to a further aspect of the present invention includes: a sheet feeding apparatus having the constitution described above; and an image forming apparatus main body for forming an image on a sheet fed from the sheet feeding apparatus.

DETAILED DESCRIPTION OF THE PREFERRED EMBODIMENTS

Figure 1:
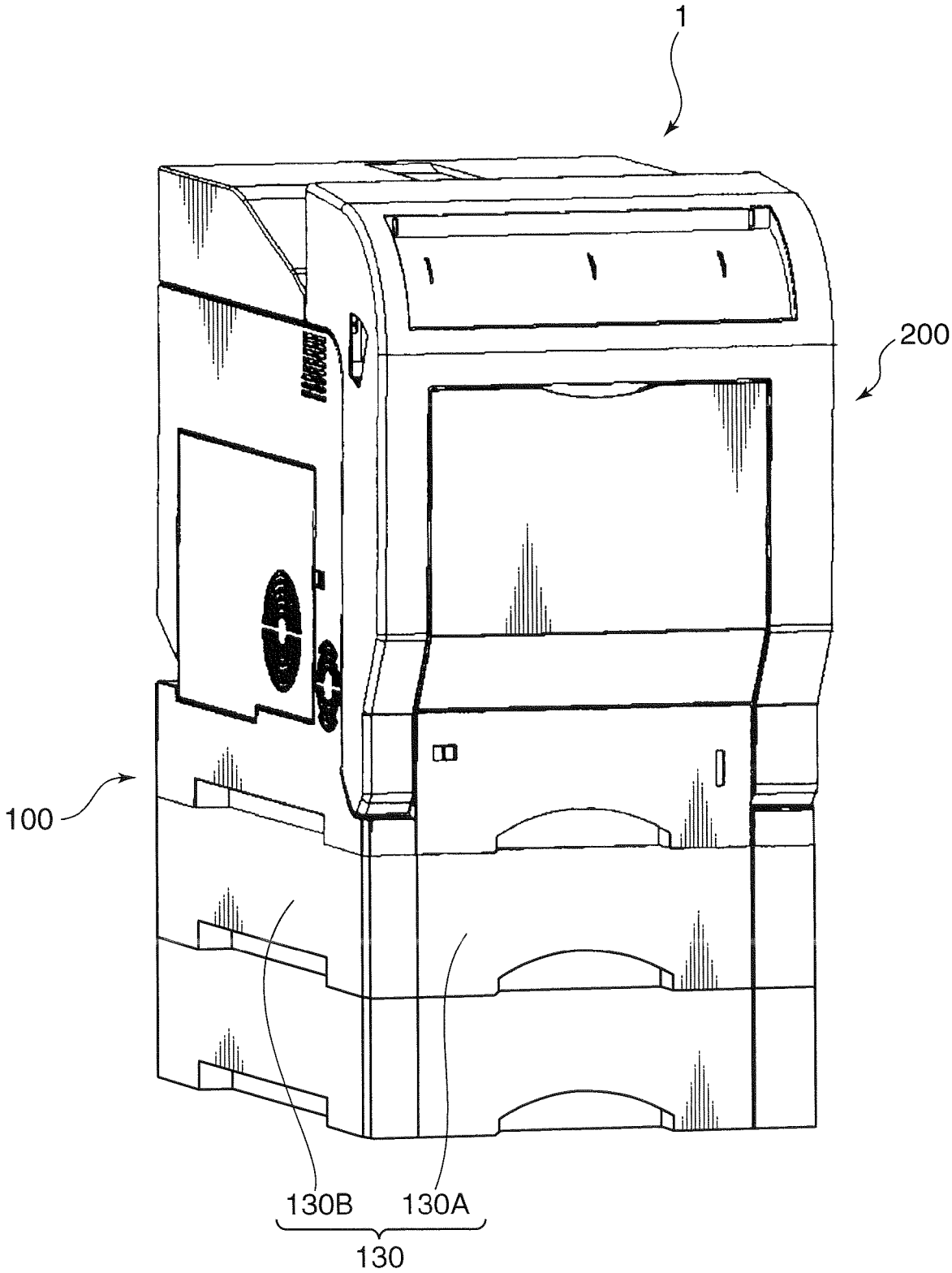
FIG. 1 is a perspective view showing the outer form of a printer including a warm air generating apparatus according to an embodiment of the present invention.
Figure 2:
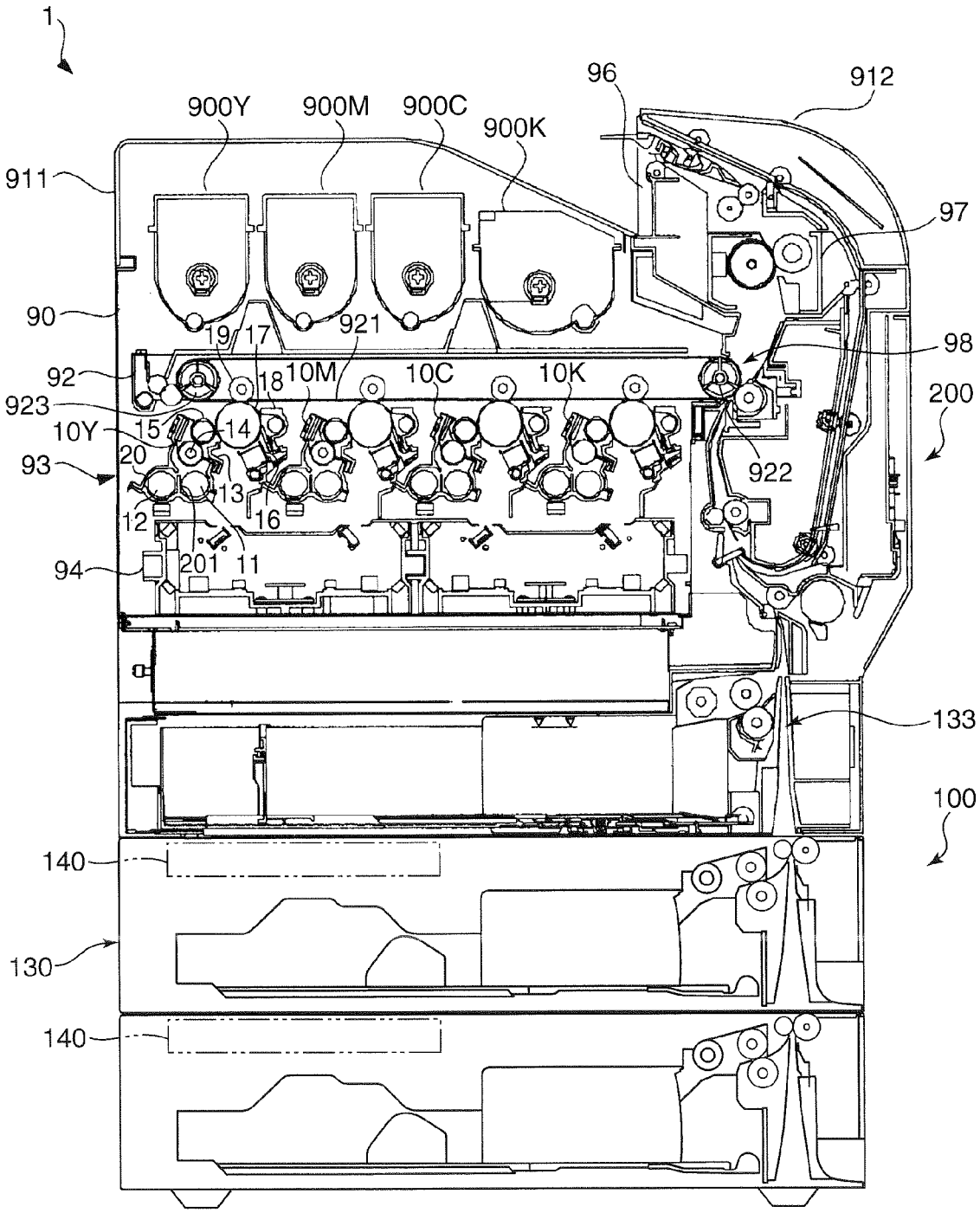
FIG. 2 is a sectional view showing the internal constitution of the printer shown in FIG. 1.

FIG. 1 is a perspective view showing the outer form of an image forming apparatus including a sheet feeding apparatus (warm air generating apparatus) according to an embodiment of the present invention. FIG. 2 is a sectional view showing the internal structure of the image forming apparatus. In this embodiment, a color printer 1 is cited as an example of the image forming apparatus.

The color printer 1 includes a printer main body 200 (image forming apparatus main body) connected to a personal computer (not shown) or the like directly or via a LAN, and a sheet supply portion 100 provided beneath the printer main body 200 and constituted to be capable of storing sheets P (sheet-form recording medium) of various sizes in accordance with their size. Note that the color printer 1 also includes other constitutional elements typically provided in a color printer, such as a control circuit for controlling operations of the color printer 1.

As shown in FIG. 2, the printer main body 200 includes toner containers 900Y, 900M, 900C, 900K, an intermediate transfer unit 92, an image formation unit 93, an exposure unit 94, a fixing unit 97, a sheet discharge unit 96, an apparatus main body casing 90, a top cover 911, and a front cover 912.

The image formation unit 93 includes a yellow toner container 900Y, a magenta toner container 900M, a cyan toner container 900C, a black toner container 900K, and developing apparatuses 10Y, 10M, 10C, 10K disposed therebelow in accordance with the respective colors YMCK.

Photosensitive drums 17 for carrying toner images in the respective colors are provided in the image formation unit 93. A photosensitive drum using an amorphous silicon (a-Si)-based material may be employed as the photosensitive drum 17. Yellow, magenta, cyan, and black toner is supplied to the respective photosensitive drums 17 from the corresponding toner container 900Y, 900M, 900C, 900K. Note that the image formation unit 93 according to this embodiment is capable of forming a full color image, as described above, but the present invention is not limited thereto, and the image formation unit may be constituted to form monochrome images or color images that are not full color.

A charger 16, the developing apparatuses 10 (10Y, 10M, 10C, 10K), a transfer roller 19, a cleaning apparatus 18, and so on are disposed around the photosensitive drum 17. The charger 16 charges the surface of the photosensitive drum 17 uniformly.

After being charged, the surface of the photosensitive drum 17 is exposed by the exposure unit 94 such that an electrostatic latent image is formed thereon. The developing apparatuses 10Y, 10M, 10C, 10K use the colored toner supplied from the respective toner containers 900Y, 900M, 900C, 900K to develop (make visible) the electrostatic latent images formed on the respective photosensitive drums 17. The transfer roller 19 forms a nip portion by pressing an intermediate transfer belt 921 against the photosensitive drum 17 and thereby subjects the toner image formed on the photosensitive drum 17 to primary transfer onto the intermediate transfer belt 921. The cleaning apparatus 18 cleans the peripheral surface of the photosensitive drum 17 following toner image transfer.

Each developing apparatus 10Y, 10M, 10C, 10K includes a casing 20, and a two-component developer constituted by a magnetic carrier and a toner is housed in the interior of the casing 20. Further, two agitating rollers 11, 12 are disposed rotatably in the vicinity of a bottom portion of the casing 20 so as to be parallel when a lengthwise direction is taken as an axial direction.

A developer circulation route is set on the interior bottom surface of the casing 20, and the agitating rollers 11, 12 are disposed on the circulation route. A partition wall 201 standing upright from the casing bottom portion is provided in the axial direction between the agitating rollers 11, 12. The partition wall 201 defines the circulation route, and the circulation route is formed to traverse the periphery of the partition wall 201. The two-component developer is charged while being agitated by the agitating rollers 11 and 12 so as to travel along the circulation route.

The two-component developer circulates through the casing 20 while being agitated by the agitating rollers 11 and 12, whereby the toner is charged and the two-component developer on the agitating roller 11 is aspirated onto and conveyed by a magnetic roller 14 positioned on an upper side thereof. The aspirated two-component developer forms a magnetic brush (not shown) on the magnetic roller 14. A layer thickness of the magnetic brush is limited by a doctor blade 13. A toner layer is formed on a developing roller 15 by a potential difference between the magnetic roller 14 and the developing roller 15, and the electrostatic latent image on the photosensitive drum 17 is developed by the toner layer on the developing roller 15.

The exposure unit 94 includes various optical devices such as a light source, a polygon mirror, a reflection mirror, and a deflection mirror, and irradiates the peripheral surface of the photosensitive drum 17 provided in each of the image formation units 93 with light based on image data to form the electrostatic latent image.

The intermediate transfer unit 92 includes the intermediate transfer belt 921, a drive roller 922, and a driven roller 923. The intermediate transfer belt 921 performs a primary transfer operation in which toner images are superimposed thereon from the plurality of photosensitive drums 17. The resultant toner image is then subjected to secondary transfer onto a sheet P supplied by the sheet supply portion 100 in a secondary transfer portion 98. The drive roller 922 and driven roller 923 drive the intermediate transfer belt 921 to revolve. The drive roller 922 and driven roller 923 are supported by a casing, not shown in the drawings, to be free to rotate.

The fixing unit 97 implements fixing processing on the toner image subjected to secondary transfer onto the sheet P, and includes a fixing roller having an inbuilt heat source and a pressure roller for forming a fixing nip portion with the fixing roller. Following completion of the fixing processing, the sheet P is conveyed toward the discharge unit 96, which is formed in an upper portion of the apparatus main body 200.

The sheet discharge unit 96 discharges the sheet P conveyed thereto from the fixing unit 97 onto the top cover 911, which serves as a sheet discharge tray.

The sheet supply portion 100 includes a plurality of (three in this embodiment) sheet feeding units 130 (sheet feeding apparatuses) attached detachably to the casing 90 of the printer main body 200 in tiers, and a sheet feeding conveyance path 133 for conveying the sheets P stored in the respective sheet feeding units 130 toward the image forming unit 93. Each sheet feeding unit 130 accommodates a sheet stack S constituted by a plurality of sheets P to be subjected to image formation. Sheet stacks S having different sizes are stored in the respective sheet feeding units 130. In a selected sheet feeding unit 130, a sheet P on the uppermost layer of the sheet stack S are extracted one at a time by driving a pickup roller 40 (see FIG. 4) provided in the sheet feeding unit 130, dispatched onto the sheet feeding conveyance path 133, and introduced into the image formation unit 93.

Each sheet feeding unit 130 includes a conveyance mechanism, a plurality of which can be attached subsequently to a lower portion of the printer main body 200 in stacked tiers, and thus a desired number of the sheet feeding units 130 can be attached subsequently to the printer main body 200 at any time. In other words, by stacking a plurality of the sheet feeding units 130 in the lower portion of the printer main body 200, the conveyance mechanisms provided in the respective sheet feeding units 130 are coupled to each other to form the single sheet feeding conveyance path 133 extending to the printer main body 200. Hence, the sheet feeding units 130 can be attached subsequently in a plurality of stacked tiers. Note that in this embodiment, an example in which the sheet supply portion 100 is constituted by three sheet feeding units 130 is described, but the present invention is not limited to this example, and one, two, four, or more sheet feeding units 130 may be provided.

Figure 3:
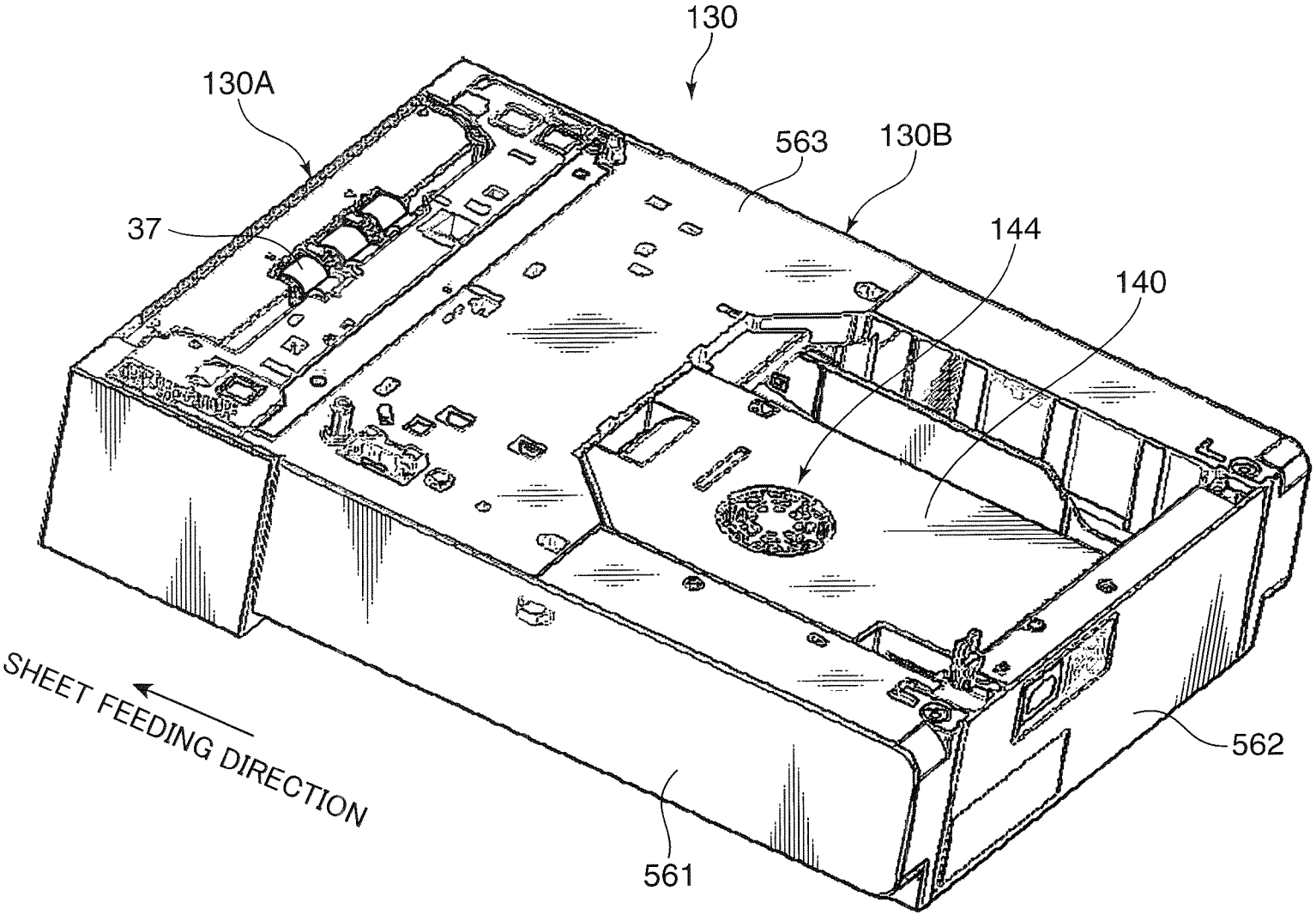
FIG. 3 is a perspective view of a sheet feeding unit.
Figure 4:
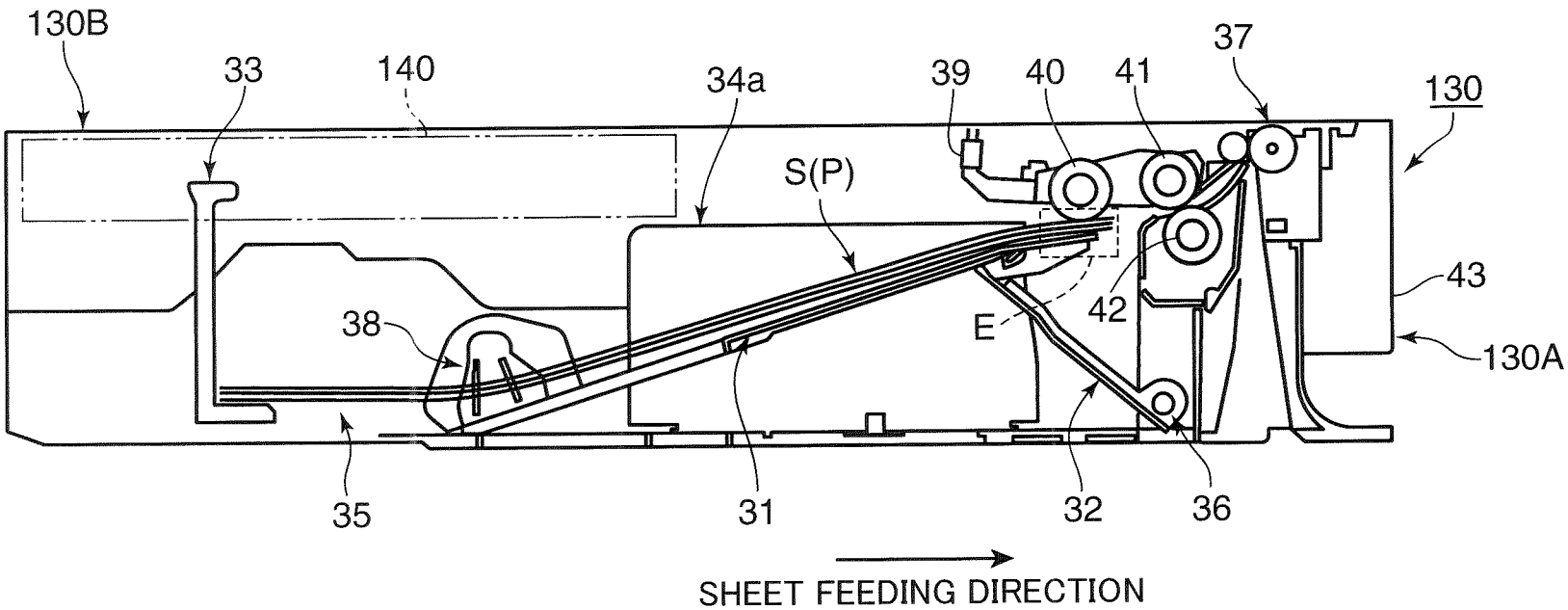
FIG. 4 is a sectional side view of the sheet feeding unit.
Figure 5:
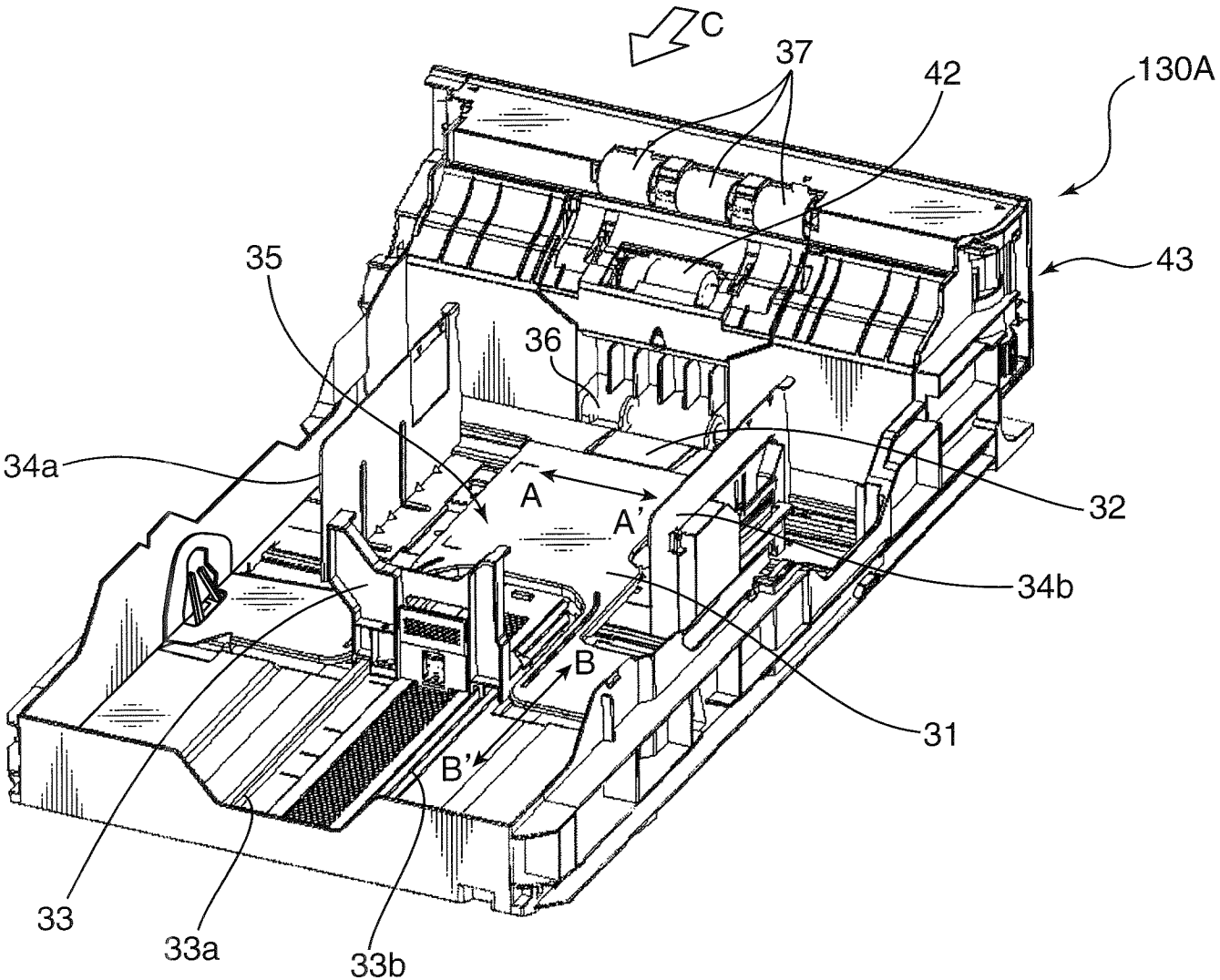
FIG. 5 is a perspective view of a sheet feeding cassette.

Next, the constitution of the sheet feeding unit 130 will be described in detail. FIG. 3 is a perspective view of a single sheet feeding unit 130. FIG. 4 is a sectional side view of the sheet feeding unit 130. FIG. 5 is a perspective view of a sheet feeding cassette 130A. The sheet feeding unit 130 is constituted by the sheet feeding cassette 130A and a sheet feeding unit main body 130B. The sheet feeding cassette 130A slides forward and backward relative to the sheet feeding unit main body 130B in a sheet feeding direction, and is capable of attitude variation between a withdrawn attitude withdrawn from the sheet feeding unit main body 130B and a housed attitude housed in the sheet feeding unit main body 130B.

As shown in FIG. 3, the sheet feeding unit main body 130B takes the shape of a box having a cavity capable of accommodating the sheet feeding cassette 130A. To form this box shape, the sheet feeding unit main body 130B includes a side plate 561 formed parallel to the sheet feeding direction, a rear plate 562 positioned on an upstream side of the sheet feeding direction, and a ceiling plate 563 covering substantially half of an upper portion surface on a downstream side of the sheet feeding direction. Further, as shown in FIG. 4, a position detection sensor 39, to be described below, the pickup roller 40, and a sheet feeding roller 41 are attached to the sheet feeding unit main body 130B.

Moreover, in this embodiment, a warm air generating apparatus 140 is incorporated into a sheet feeding direction upstream side upper portion of the sheet feeding unit main body 130B. The warm air generating apparatus 140 is disposed to improve the sheet P loosening performance by blowing warm air onto the sheet stack S, which is constituted by a stacked body of the sheets P housed in the sheet feeding unit 130, from an upper surface side. The warm air generating apparatus 140 will be described in detail below on the basis of FIGS. 6 to 10.

The sheet feeding cassette 130A includes a sheet accommodating portion 35 accommodating the sheet stack S constituted by a plurality of the sheets P. A lift plate 31 for carrying the sheet stack S is provided on an inner bottom surface of the sheet accommodating portion 35. A sheet feeding direction upstream end (a left side end portion in FIG. 4) of the lift plate 31 is supported rotatably by a support portion. In other words, the lift plate 31 can be rotated by the support portion in a vertical plane in the interior of the sheet accommodating portion 35 using a downstream end thereof as a free end. The support portion is provided on wall portions on either side of the sheet accommodating portion 35, which is disposed to face a width direction of the sheet P (an orthogonal direction to the sheet feeding direction).

Further, the sheet feeding cassette 130A includes a pair of width alignment cursors 34*a*, 34*b* for positioning the sheet stack S accommodated in the sheet accommodating portion 35 in the width direction, a rear end cursor 33 for aligning a rear end of the sheet stack S, and a cassette cover 43. The pair of width alignment cursors 34*a*, 34*b* are provided to be capable of performing a reciprocating motion in the sheet width direction (a direction indicated by an arrow AA' in FIG. 5) along respective guide rails, not shown in the drawings. Here, the sheet P is dispatched in a direction indicated by an arrow B, and therefore the rear end cursor 33 is provided to be capable of performing a reciprocating motion parallel to the sheet conveyance direction (a direction indicated by an arrow BB' in FIG. 5) along guide rails 33*a*, 33*b*. The sheet stack S is accommodated in a predetermined position of the sheet feeding unit 130 by moving the width alignment cursors 34*a*, 34*b* and the rear end cursor 33 in accordance with the size of the carried sheets. The cassette cover 43 serves as an outer cover, a front surface side (a side seen from a direction indicated by an arrow C in FIG. 5) of which is exposed to the outside to form a part of an outer surface of the color printer 1.

A drive shaft 36, a push-up member 32, and a driving connecting member (not shown) are provided in the sheet feeding cassette 130A below a sheet feeding direction downstream portion of the lift plate 31 as an elevator mechanism for raising and lowering the lift plate 31. Further, a receiving member (not shown) corresponding to the driving connecting member and a stepping motor (not shown) that is connected to the receiving member and capable of normal and reverse rotation are provided on the sheet feeding unit main body 130B side.

When the sheet feeding cassette 130A is accommodated in the sheet feeding unit main body 130B, the driving connecting member on the sheet feeding cassette 130A side engages connectedly with the receiving member on the sheet feeding unit main body 130B side. Thus, the power of the stepping motor is transmitted to the drive shaft 36. The elevator mechanism, which displaces the lift plate 31 between a sheet feeding position and a withdrawn position, is constituted by the drive shaft 36, the push-up member 32, the driving connecting member, the receiving member, and the stepping motor. In the sheet feeding position, the lift plate 31 is raised such that an upper face of the sheet stack S carried on the lift plate 31 contacts the pickup roller 40, enabling sheet feeding. In the withdrawn position, the lift plate 31 is lowered to a lower limit position.

As shown in FIG. 4, the sheet feeding unit 130 includes a sheet feeding roller 41 provided on a conveyance direction downstream side of the pickup roller 40, and a loosening roller 42 provided below the sheet feeding roller 41. Further, a conveyance roller 37 is provided on the conveyance direction downstream side of the pickup roller 40 and the sheet feeding roller 41. The sheet feeding roller 41 is provided on the sheet feeding unit main body 130B side together with the pickup roller 40, whereas the loosening roller 42 and the conveyance roller 37 are provided on the sheet feeding cassette 130A side. When the sheet feeding cassette 130A is attached to the sheet feeding unit main body 130B, the sheet feeding roller 41 contacts the loosening roller 42.

The sheet feeding roller 41 feeds a sheet P dispatched by the pickup roller 40 to the conveyance roller 37. The sheet feeding roller 41 rotates in a direction for conveying the sheet P downstream, whereas the loosening roller 42 rotates in an opposite direction for returning the sheet P upstream. In a case where a plurality of overlapped sheets P are extracted by the conveyance pickup roller 40, the loosening roller 42 can be used to prevent all but the uppermost sheet P from being fed in the direction of the conveyance roller 37, and thus only the uppermost sheet P is conveyed to the conveyance roller 37 by the sheet feeding roller 41. The conveyance roller 37 conveys the sheet P onto the sheet feeding conveyance path 133 (see FIG. 2).

Further, as shown in FIG. 4, the sheet feeding unit 130 includes the position detection sensor 39 for detecting that the uppermost sheet P of the sheet stack S carried on the lift plate 31 is in the sheet feeding position. The position detection sensor 39 is constituted by an optical sensor for projecting and receiving light, and a light blocking member for blocking the optical path of the projected/received light. The light blocking member operates in conjunction with the pickup roller 40 to block the optical path when the uppermost sheet P reaches a predetermined height.

Figure 6:
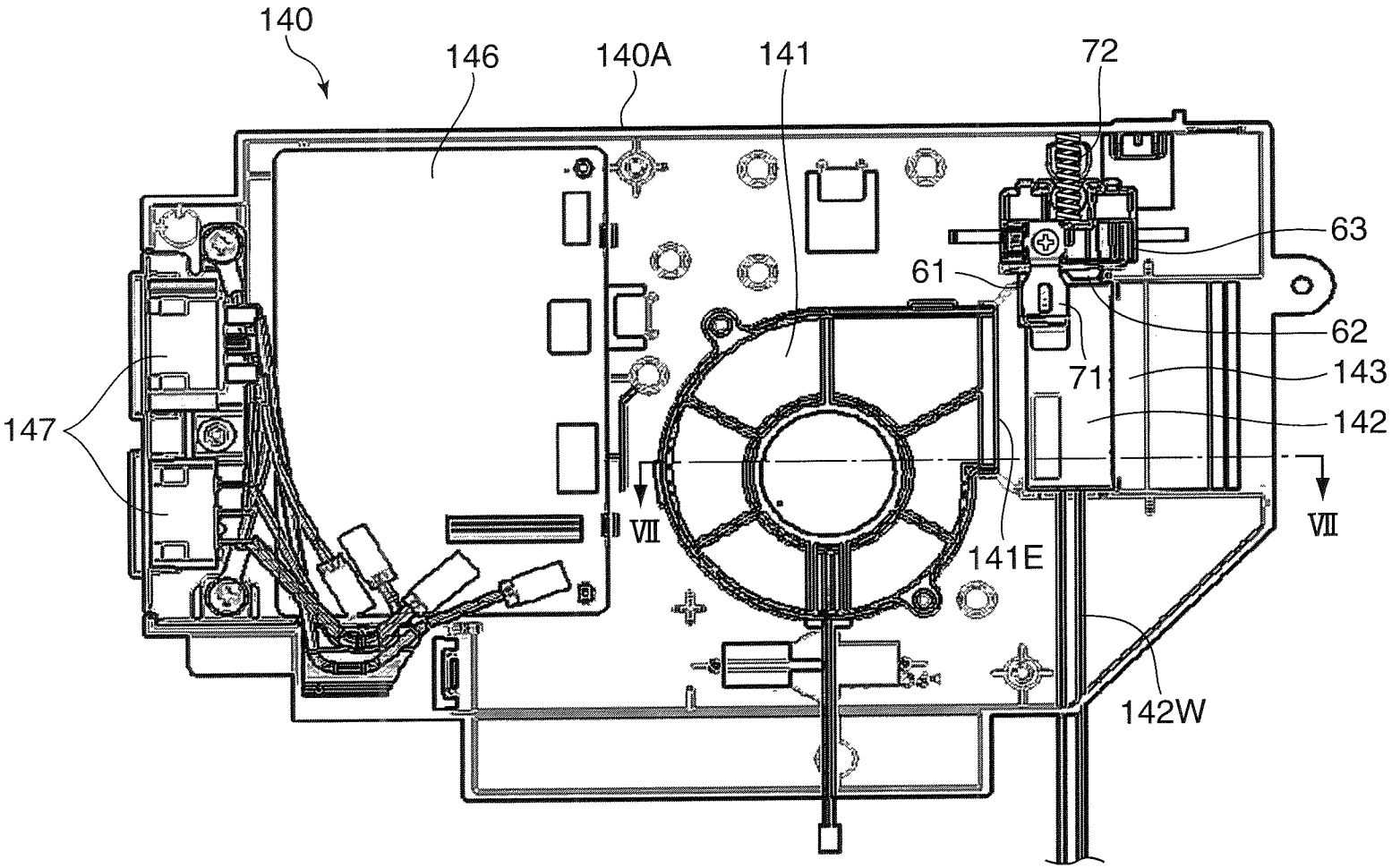
FIG. 6 is an upper face plan view showing the internal structure of the warm air generating apparatus.
Figure 7:
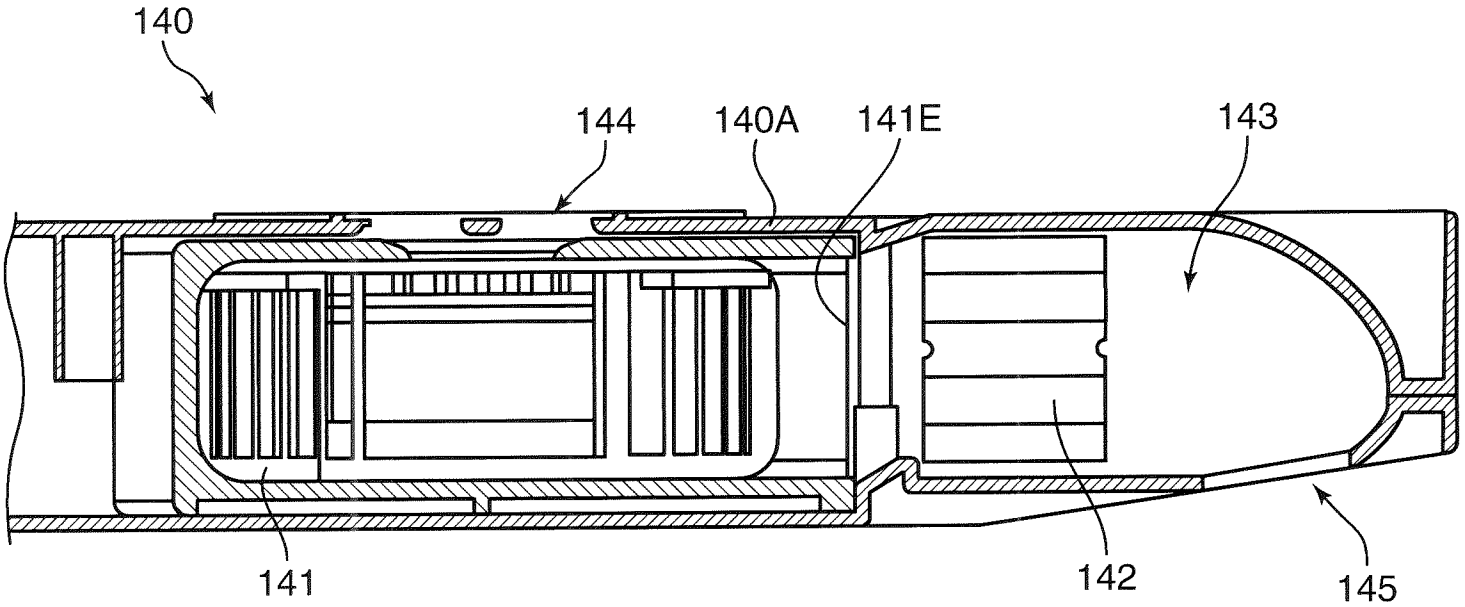
FIG. 7 is a sectional view taken along a VII-VII line of FIG. 6.

Next, the warm air generating apparatus 140 will be described in detail. FIG. 6 is an upper face plan view showing the internal structure of the warm air generating apparatus 140. FIG. 7 is a sectional view taken along a VII-VII line of FIG. 6. The warm air generating apparatus 140 includes a casing structure covered by a casing 140A (in FIG. 6, an upper side part of the casing 140A is omitted), and a fan 141 (blowing apparatus), a heater 142 (heating member), an air duct 143, a control board 146, a connector 147, a thermistor 61 (a temperature detection member), a thermostat 62 (another temperature detection member), a leaf spring 71 (a biasing member), and a coil spring 72 (another biasing member) are housed in the casing 140A. A suction port 144 for taking in air from the outside is formed in an upper face of the casing 140A, and a warm air blowing port 145 for blowing warm air onto the upper face of the sheet stack S is formed in a lower face of the casing 140A.

The fan 141 is a multiblade fan (sirocco fan) that serves as a blower for generating an air flow in a centrifugal direction of the fan. When the fan 141 is driven, outside air is taken in through the suction port 144 positioned above a fan rotary axis, whereupon an air flow is dispatched toward the air duct 143 through a fan blowing port 141E.

Figure 8:
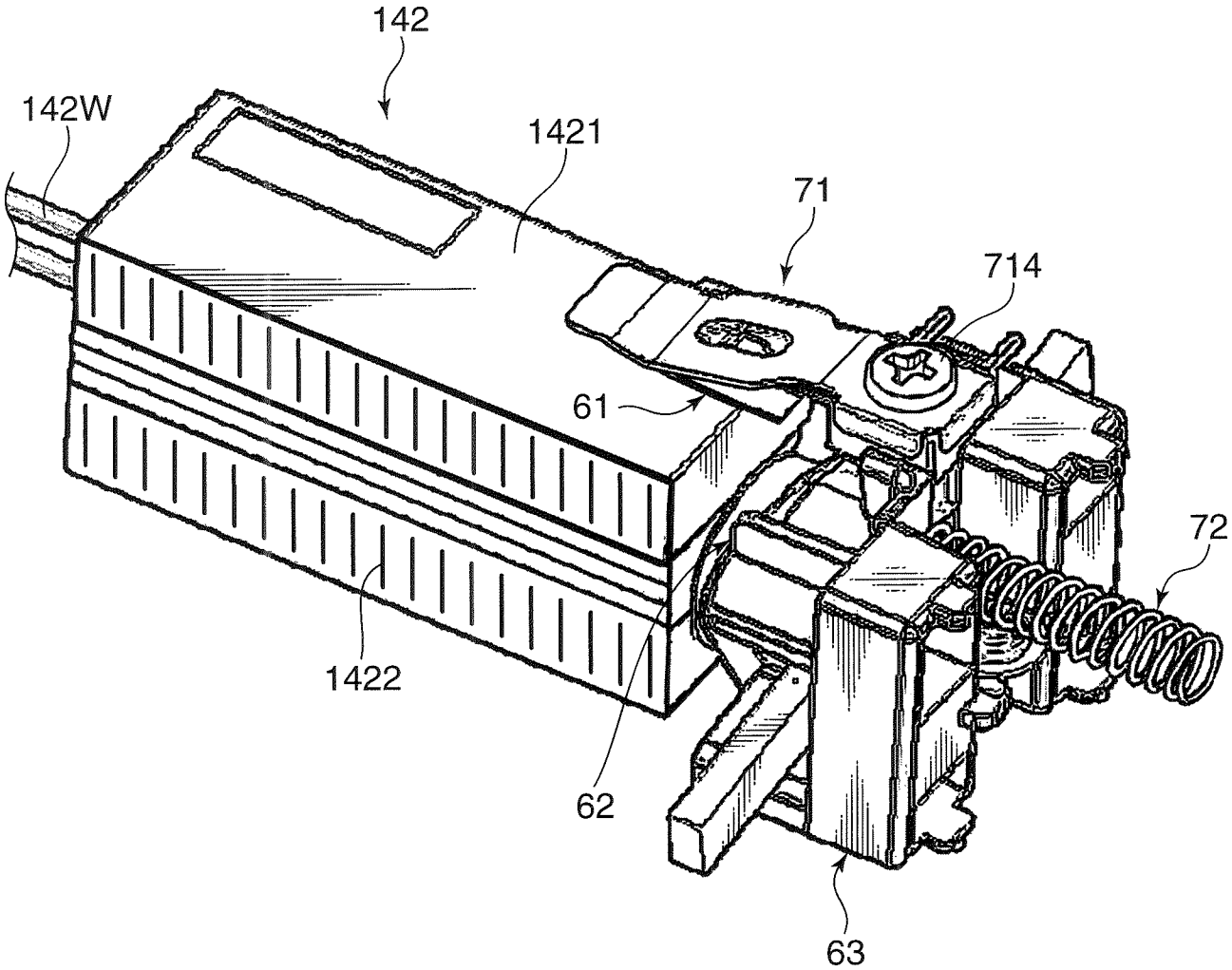
FIG. 8 is a perspective view showing a heater and attached components thereof.

The heater 142 is disposed in the air duct 143 to heat the air discharged through the fan blowing port 141E. FIG. 8 is a perspective view showing the heater 142 and attached components thereof. The heater 142 heats the air of the air flow as the air flow passes through, and includes a rectangular parallelepiped cylinder-shaped duct outer wall 1421 forming an air flow passage space, and a wave-shaped heater member 1422 housed in the duct outer wall 1421. The heater member 1422 can be electrified via a feeder wire 142W so as to generate heat when electrified. This heat is applied to the air flow passing through the duct outer wall 1421, whereby warm air heated to a predetermined temperature is generated.

The air duct 143 leads the air flow generated by the fan 141 to the warm air blowing port 145, and is connected to the fan blowing port 141E on one end side and to the warm air blowing port 145 on the other end side. By disposing the tubular heater 142 inside the air duct 143, warm air can be blown through the warm air blowing port 145 when the heater member 1422 is electrified.

The control board 146 is a board mounting power supply circuit components and electronic components for drive-controlling the fan 141 and heater 142 and controlling temperature detection performed by the thermistor 61. The connector 147 includes a feeder terminal for receiving a power supply from a feeder system of the printer main body 200, and a communication terminal that is electrically connected to a control system of the printer main body 200.

By providing the warm air generating apparatus 140 in the sheet feeding unit 130, air can be taken in through the suction port 144, and warm air can be blown through the warm air blowing port 145 toward the upper face of the sheet stack S accommodated in the sheet accommodating portion 35. An upper face and a peripheral part of the sheet stack S are exposed to outside air, and are therefore likely to contain a large amount of moisture. In other words, the upper face and side faces of the sheet stack S swell due to moisture absorption, whereas the inside of the sheet stack S contains a smaller amount of moisture than the upper face and side faces and therefore exhibits a relatively lower degree of swelling. As a result, a phenomenon occurs whereby pressure inside (in the inter-sheet spaces of) the sheet stack S turns negative such that the sheets P stick together. This phenomenon may lead to multi-feeding of the sheets P.

However, by blowing warm air from the warm air generating apparatus 140, a relative humidity of the sheet stack S (the humidity of the upper face and peripheral part of the sheet stack S relative to the other parts) can be reduced instantaneously, and as a result, negative pressure on the inside of the sheet stack S can be eliminated. Hence, a reduction in the inter-sheet sticking force can be achieved, and therefore the sheet stack S can be loosened efficiently during sheet feeding.

As shown in FIG. 8, in the warm air generating apparatus 140, the thermistor 61 and thermostat 62 are annexed to the heater 142 while held by a support member 63 in order to ON-OFF control the heater 142 and prevent overheating of the heater 142. The thermistor 61 and thermostat 62 are caused to contact the heater 142 (duct outer wall 1421) and biased by the leaf spring 71 and the coil spring 72, respectively, so as to be pressed against the outer wall 1421 (a part of heating member).

Figure 9:
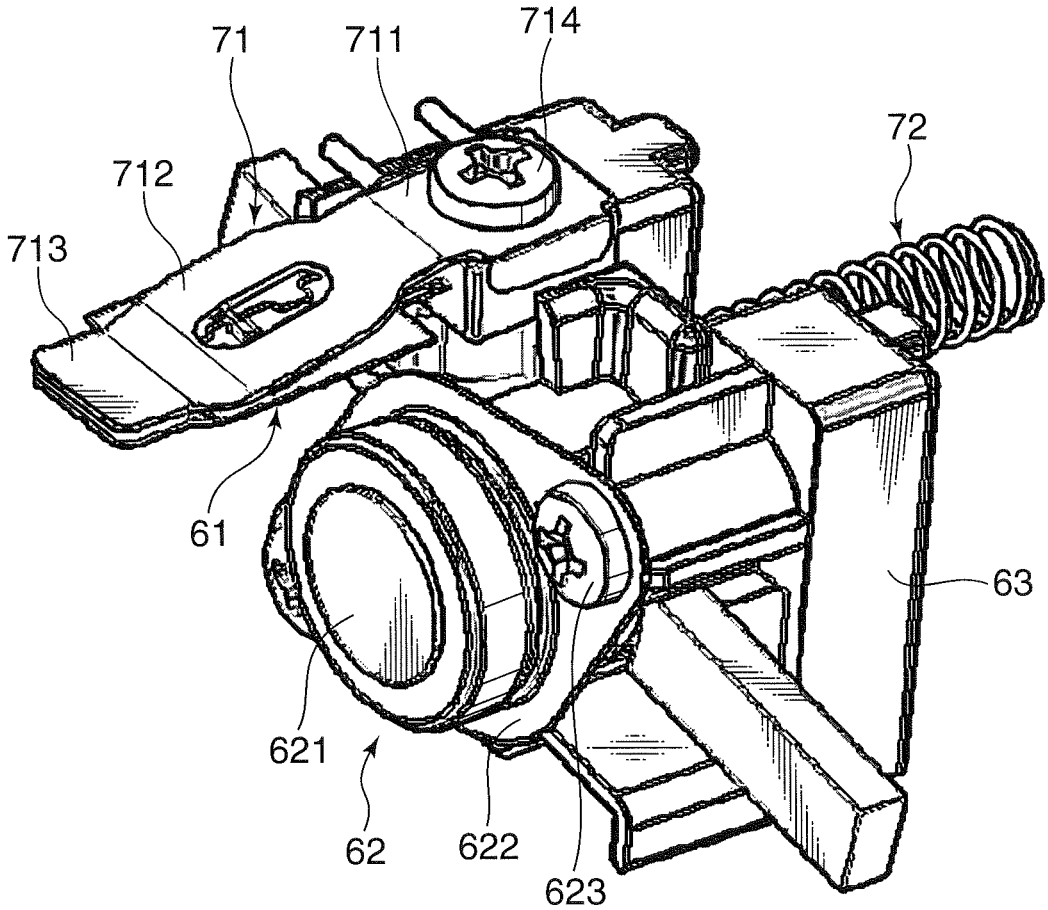
FIG. 9 is a perspective view showing a state in which the heater is omitted from FIG. 8.
Figure 10:
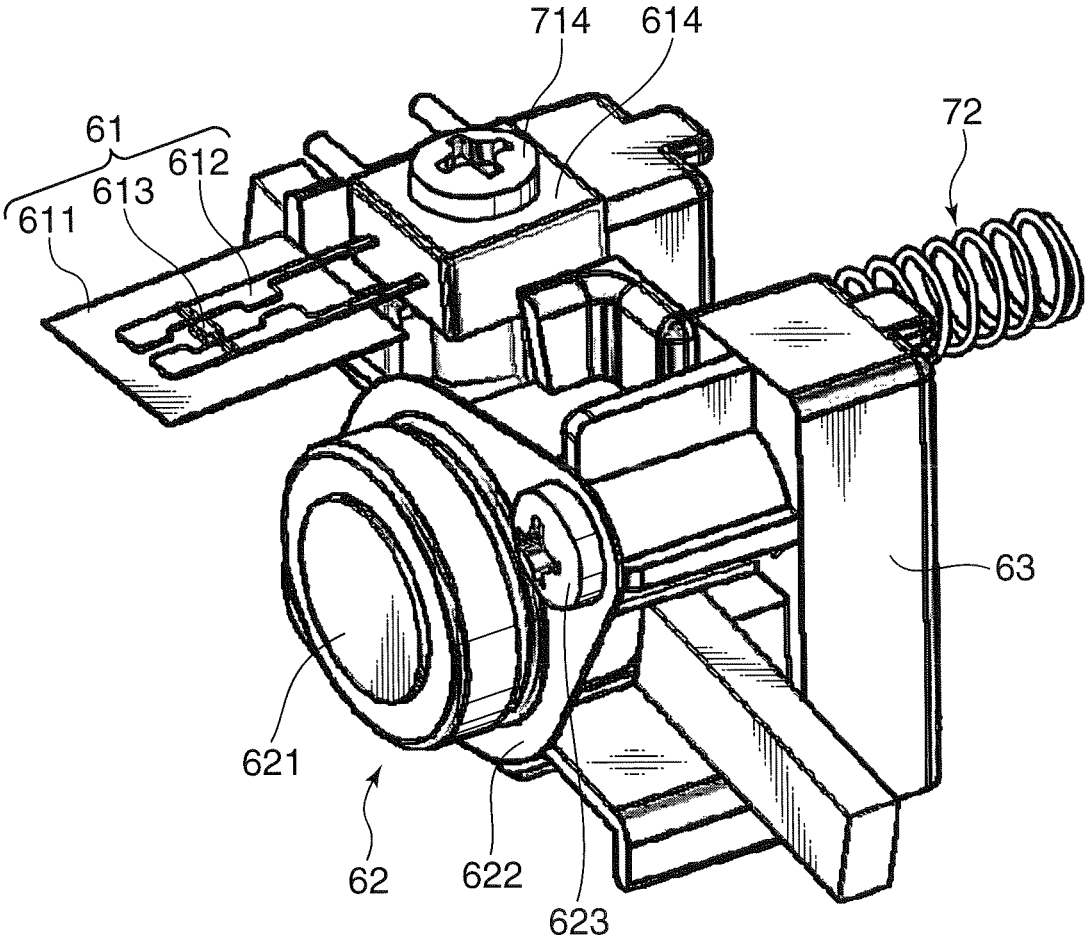
FIG. 10 is a perspective view showing a state in which the heater and a leaf spring are omitted from FIG. 8.

FIG. 9 is a perspective view showing a state in which the heater 142 is omitted from FIG. 8, and FIG. 10 is a perspective view showing a state in which the leaf spring 71 is also omitted. The thermistor 61 includes a flat plate-shaped base board 611, a pair of lead frames 612 mounted on the base board 611, and a heat sensing portion 613 connected to the pair of lead frames 612. The heat sensing portion 613 is a chip member having an electric resistance that decreases as the temperature rises, for example. The base board 611 is constituted by a metal plate exhibiting a soaking action, and is contacted by the heat sensing portion 613. Further, the lead frames 612 extend from a terminal mold 614, and the terminal mold 614 is fixed to the support member 63 by a screw 714.

The thermostat 62 is an element that is connected to a feeder circuit for supplying power to the heater 142 from a power supply, not shown in the drawings, and forcibly halts electrification of the heater 142 from the power supply when a predetermined temperature is detected thereby. The thermostat 62 includes a heat sensing portion 621 and an attachment flange portion 622. A bimetal contact, for example, is provided in the heat sensing portion 621, and when the heat sensing portion 621 is heated to a predetermined high temperature, the bimetal contact is activated to open, thereby blocking the electrification circuit for electrifying the heater 142. The thermostat 62 is fixed to the support member 63 on the flange portion 622 by a screw 623.

As shown in FIGS. 8 and 9, the thermistor 61 is pressed against the upper face of the duct outer wall 1421 by the leaf spring 71. The leaf spring 71 includes a base end portion 711 having a screw hole penetrated by the hinge 714, an inclined portion 712 that forms a continuation of the base end portion 711, and a tip end flat portion 713 connected to a tip end of the inclined portion 712. A folded portion folded such that an appropriate pressing force is obtained is formed between the base end portion 711 and the inclined portion 712.

The base end portion 711 is fixed to the support member 63 by the screw 714 via the terminal mold 614. In this state, a lower face of the tip end flat portion 713 contacts an upper face of the base board 611 of the thermistor 61, and a spring force thereof presses the base board 611 against the duct outer wall 1421 of the heater 142. Hence, the contact state between the thermistor 61 (heat sensing portion 613) and the heater 142 (duct outer wall 1421) is stabilized such that even when thermal expansion occurs or vibration is applied on a long-term basis, the thermistor 61 and heater 142 do not separate from each other. Therefore, the temperature of the heater 142 can be detected accurately at all times, and on the basis of the detected temperature value of the thermistor 61, ON-OFF control and temperature control of the heater 142 can be executed appropriately.

Further, the support member 63 is biased by the coil spring 72 in a direction approaching the heater 142. As a result of this biasing force, the heat sensing portion 621 of the thermostat 62, which is fixed integrally to the support member 63, is pressed against a side wall of the duct outer wall 1421. Hence, the contact state between the thermostat 62 (heat sensing portion 621) and the heater 142 (duct outer wall 1421) is stabilized such that even when thermal expansion occurs or vibration is applied on a long-term basis, the thermostat 62 and heater 142 do not separate from each other. Therefore, when overheating or the like occurs in the heater 142, this can be detected accurately, and as a result, the thermostat 62 can be activated appropriately to protect the heater 142 and peripheral members thereof.

The color printer 1 having the warm air generating apparatus 140 according to an embodiment of the present invention was described above, but the present invention is not limited to this embodiment, and may include the following embodiments, for example.

(1) In the embodiment described above, a case in which the warm air generating apparatus 140 blows warm air onto the upper face of the sheet stack S was described. Instead of or in addition to this warm air generating apparatus 140, warm air may be blown between the sheets P from the side face of the sheet stack S. In this case, a warm air blowing port is preferably set in a part where the pickup roller 40 contacts the upper face of the sheet stack S (in FIG. 4, a dotted line part indicated by the reference symbol E). The lift plate 31 is then preferably raised and lowered between the sheet feeding position and the withdrawn position. According to this constitution, warm air can be dispatched reliably between the sheets P, enabling a further improvement in the sheet P loosening performance.

(2) In the embodiment described above, the sirocco fan 141 was cited as an example of blowing means. However, the present invention is not limited to this example, and an axial fan that suctions air from one side of a rotary axis direction and blows the suctioned air to the other side of the rotary axis direction, for example, maybe used instead. Further, the cylindrical heater 142 was cited as an example of heating means, but various other heaters may be used instead.

(3) In the embodiment described above, the thermistor 61 and thermostat 62 were cited together as an example of temperature detecting means. However, either one of the thermistor 61 and the thermostat 62 may be provided alone.

(4) In the embodiment described above, an example in which the warm air generating apparatus 140 is applied to the color printer 1 was described, but the present invention is not limited thereto, and the warm air generating apparatus may be applied to another image forming apparatus such as a copier, a FAX apparatus, or a compound machine thereof. The warm air generating apparatus may also be applied to an electric machine or a mechanical apparatus other than an image forming apparatus.

Note that the specific embodiment described above mainly includes inventions having the following constitutions.

A warm air generating apparatus according to one aspect of the present invention, including: a blowing apparatus for generating an air flow in a predetermined direction; a heating member disposed on a flow path of the air flow for heating air; a temperature detection member that has a heat sensing portion and detects a temperature of the heating member; and a biasing member for applying a biasing force that causes the heat sensing portion to contact a part of the heating member.

According to this constitution, the heat sensing portion of the temperature detection member is caused to contact a part of the heating member by a biasing force of the biasing member.

Therefore, separation of the heat sensing portion and the heating member due to a difference in the respective coefficients of thermal expansion of the members or the like does not occur, and the temperature of the heating member can be detected accurately at all times.

In the constitution described above, the heating member is preferably a heater that includes a heating cylinder and heats the air while causing the air flow to pass through the heating cylinder, and the heat sensing portion preferably contacts a wall surface of the heating cylinder. According to this constitution, the air flow generated in the blowing apparatus can be heated simply by being passed through the cylinder.

Furthermore, the heat sensing portion contacts the cylinder wall, and therefore the heat sensing portion can be biased with stability while simplifying the biasing structure. Hence, the structure of the warm air generating apparatus can be simplified.

In the constitution described above, the biasing member is preferably a leaf spring or a coil spring. According to this constitution, the structure of the biasing member can be simplified.

Further, the heating member may include a duct outer wall and a wave-shaped heater disposed in the duct outer wall, the biasing member may be constituted by a spring member, and the heat sensing portion may contact the duct outer wall when pressed by the spring member.

The constitution described above preferably further includes: a casing that houses the blowing apparatus, the heating member, the temperature detection member, and the biasing member and includes an air intake port and a warm air blowing port; and an air duct that is provided in the casing and leads the air flow generated by the blowing apparatus to the warm air blowing port, wherein the heating member is disposed in the air duct. According to this constitution, the air flow is heated by the heating member in the air duct disposed in the casing, and therefore heated air can be generated efficiently.

In this case, the heating member is preferably a heater that includes a heating cylinder and heats the air while causing the air flow flowing through the air duct to pass through the heating cylinder, and the heat sensing portion preferably contacts a wall surface of the heating cylinder. According to this constitution, the heating member can be assembled easily.

A control board that is housed in the casing and mounts at least an electronic component for controlling an operation of the heating member on the basis of the temperature detected by the temperature detection member is preferably further included. According to this constitution, temperature control of the heating member can be performed by the warm air generating apparatus alone.

A sheet feeding apparatus according to another aspect of the present invention includes: a sheet accommodating portion for accommodating a sheet stack constituted by a plurality of sheets; and the warm air generating apparatus described above, which is capable of blowing warm air onto the sheet stack accommodated in the sheet accommodating portion.

An image forming apparatus according to a further aspect of the present invention includes: the sheet feeding apparatus described above; and an image forming apparatus main body for forming an image on a sheet fed from the sheet feeding apparatus.

In this case, a casing that houses the blowing apparatus, the heating member, the temperature detection member, and the biasing member and includes an air intake port and a warm air blowing port is also provided, and the warm air blowing port is disposed in a position for blowing warm air toward an upper face of the sheet stack accommodated in the sheet accommodating portion.

According to the present invention, a state in which the heat sensing portion of the temperature detecting means contacts a part of the heating member can be maintained, and therefore the temperature of the heating member can be detected accurately at all times. It is therefore possible to provide a warm air generating apparatus capable of performing accurate temperature control through a simple constitution, a sheet feeding apparatus including the warm air generating apparatus, and an image forming apparatus including the warm air generating apparatus and the sheet feeding apparatus.

This application is based on Japanese patent application serial No. 2008-216927, filed in Japan Patent Office on Aug. 26, 2008, the contents of which is hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A warm air generating apparatus comprising:

a blowing apparatus for generating an air flow in a predetermined direction;

a heating member disposed on a flow path of said air flow for heating air, the heating member having a first temperature detected surface and a second temperature detected surface each provided for detecting temperatures;

a first temperature detection member that has a first heat sensing portion and detects a temperature of said heating member;

a second temperature detection member that has a second heat sensing portion and detects a temperature of said heating member;

a support member for rigidly supporting the first temperature detection member and elastically supporting the second temperature detection member;

a first biasing member that causes said first heat sensing portion to contact the first temperature detected surface by biasing said support member and that causes the second temperature detection member to be disposed at a position on the second temperature detected surface; and a second biasing member mounted on said support member for applying a biasing force that causes said second heat sensing portion to contact the second temperature detected surface.

2. The warm air generating apparatus according to claim 1, wherein said heating member is a heater that includes a heating cylinder and heats said air while causing said air flow to pass through said heating cylinder, and said first and second heat detected surfaces are wall surfaces of said heating cylinder that are different from one another.

3. The warm air generating apparatus according to claim 1, wherein said first biasing member is a coil spring and said second biasing member is a leaf spring or a coil spring.

4. The warm air generating apparatus according to claim 1, wherein said heating member includes a duct outer wall and a wave-shaped heater disposed in said duct outer wall, said duct outer wall has a first surface and a second surface perpendicular to the first surface, and said first surface is said first heat detected surface and said second surface is said second heat detected surface.

5. The warm air generating apparatus according to claim 1, further comprising:

a casing that houses said blowing apparatus, said heating member, said first and second temperature detection members, and said first and second biasing members, and includes an air intake port and a warm air blowing port; and an air duct that is provided in said casing and leads said air flow generated by said blowing apparatus to said warm air blowing port, wherein said heating member is disposed in said air duct.

6. The warm air generating apparatus according to claim 5, wherein said heating member is a heater that includes a heating cylinder and heats said air while causing said air flow flowing through said air duct to pass through said heating cylinder, and said heating cylinder has a first surface and a second surface perpendicular to the first surface, and said first surface is said first heat detected surface and said second surface is said second heat detected surface.

7. The warm air generating apparatus according to claim 5, further comprising a control board that is housed in said casing and mounts at least an electronic component for controlling an operation of said heating member on the basis of the temperature detected by said first and second temperature detection members.

8. A sheet feeding apparatus comprising:

a sheet accommodating portion for accommodating a sheet stack constituted by a plurality of sheets; and a warm air generating apparatus capable of blowing warm air onto said sheet stack accommodated in said sheet accommodating portion, wherein said warm air generating apparatus includes:

a blowing apparatus for generating an air flow in a predetermined direction;

a heating member disposed on a flow path of said air flow for heating air, the heating member having a first temperature detected surface and a second temperature detected surface for detecting temperatures;

a first temperature detection member that has a first heat sensing portion and detects a temperature of said heating member;

a second temperature detection member that has a second heat sensing portion and detects a temperature of said heating member;

a support member for rigidly supporting the first temperature detection member and elastically supporting the second temperature detection member;

a first biasing member that causes said first heat sensing portion to contact the first temperature detected surface by biasing said support member and that causes the second temperature detection member to be disposed at a position on the second temperature detected surface; and a second biasing member mounted on said support member for applying a biasing force that causes said second heat sensing portion to contact the second temperature detected surface.

9. The sheet feeding apparatus according to claim 8, wherein said heating member is a heater that includes a heating cylinder and heats said air while causing said air flow to pass through said heating cylinder, and said first and second heat detected surfaces are wall surfaces of said heating cylinder that are different from one another.

10. The sheet feeding apparatus according to claim 8, further comprising:

a casing that houses said blowing apparatus, said heating member, said first and second temperature detection members, and said first and second biasing members, and includes an air intake port and a warm air blowing port; and an air duct that is provided in said casing and leads said air flow generated by said blowing apparatus to said warm air blowing port, wherein said heating member is disposed in said air duct.

11. The sheet feeding apparatus according to claim 10, further comprising a control board that is housed in said casing and mounts at least an electronic component for controlling an operation of said heating member on the basis of the temperature detected by said first and second temperature detection members.

12. An image forming apparatus comprising:

a sheet feeding apparatus; and an image forming apparatus main body for forming an image on a sheet fed from said sheet feeding apparatus, wherein said sheet feeding apparatus includes:

a sheet accommodating portion for accommodating a sheet stack constituted by a plurality of sheets; and a warm air generating apparatus capable of blowing warm air onto said sheet stack accommodated in said sheet accommodating portion, and said warm air generating apparatus includes:

a blowing apparatus for generating an air flow in a predetermined direction;

a heating member disposed on a flow path of said air flow for heating air, the heating member having a first temperature detected surface and a second temperature detected surface for detecting temperatures;

a first temperature detection member that has a first heat sensing portion and detects a temperature of said heating member;

a second temperature detection member that has a second heat sensing portion and detects a temperature of said heating member;

a support member for rigidly supporting the first temperature detection member and elastically supporting second temperature detection member;

a first biasing member that causes said first heat sensing portion to contact the first temperature detected surface by biasing said support member and that causes the second temperature detection member to be disposed at a position on the second temperature detected surface; and a second biasing member mounted on said support member for applying a biasing force that causes said second heat sensing portion to contact the second temperature detected surface.

13. The image forming apparatus according to claim 12, further comprising:

a casing that houses said blowing apparatus, said heating member, said first and second temperature detection members, and said first and second biasing members, and includes an air intake port and a warm air blowing port, wherein said warm air blowing port is disposed in a position for blowing warm air toward an upper face of said sheet stack accommodated in said sheet accommodating portion.

* * * * *